US010083784B2

(12) United States Patent
Ishikawa et al.

(10) Patent No.: US 10,083,784 B2
(45) Date of Patent: Sep. 25, 2018

(54) COMPOSITE MAGNETIC MEMBER AND METHOD OF MANUFACTURING SAME

(71) Applicant: KABUSHIKI KAISHA TOYOTA CHUO KENKYUSHO, Nagakute-shi, Aichi-ken (JP)

(72) Inventors: Hiroyuki Ishikawa, Nagakute (JP); Hiroyuki Mori, Nagakute (JP); Takeshi Hattori, Nagakute (JP)

(73) Assignee: KABUSHIKI KAISHA TOYOTA CHUO KENKYUSHO, Nakagute (JP)

( * ) Notice: Subject to any disclaimer, the term of this patent is extended or adjusted under 35 U.S.C. 154(b) by 464 days.

(21) Appl. No.: 14/711,148

(22) Filed: May 13, 2015

(65) Prior Publication Data

US 2015/0332820 A1 Nov. 19, 2015

(30) Foreign Application Priority Data

May 13, 2014 (JP) ..... 2014-099673

(51) Int. Cl.
*H01F 1/147* (2006.01)
*C23C 8/26* (2006.01)
(Continued)

(52) U.S. Cl.
CPC ..... *H01F 1/147* (2013.01); *B22F 9/14* (2013.01); *C21D 8/1294* (2013.01); *C21D 10/00* (2013.01);
(Continued)

(58) Field of Classification Search
CPC . H01F 1/147; H01F 41/02; H01F 3/00; C23C 8/26; C23C 8/38; C21D 8/1294;
(Continued)

(56) References Cited

U.S. PATENT DOCUMENTS 6,946,939 B2 * 9/2005 Doi ..... G01R 33/383 174/32
2015/0115749 A1 * 4/2015 Dial ..... H01F 1/147 310/46

FOREIGN PATENT DOCUMENTS

JP 2002-069593 A 3/2002
JP 2002069593 A * 3/2002
(Continued)

OTHER PUBLICATIONS

Mar. 15, 2016 Office Action issued in Japenese Patent Application No. 2014-099673.

*Primary Examiner* — Anthony J Zimmer
(74) *Attorney, Agent, or Firm* — Oliff PLC

(57) ABSTRACT

A composite magnetic member configured so a nonmagnetic portion different from conventional ones is formed in part of a magnetic member and includes: a base portion including a mother material containing a ferrite phase; and a nonmagnetic portion having an austenite phase that is formed by solid solution of nitrogen (N) into a part of the mother material, the nonmagnetic portion having saturated magnetization less than that of the base portion. The nonmagnetic portion can be obtained by irradiating a high energy beam to a surface portion of stainless steel or the like while relatively moving the beam. This beam is near-ultraviolet nanosecond pulse laser having a short wavelength within a near-ultraviolet range and a pulse width of 10 ps to 100 ns. By adjusting the amount of N introduced and to form a solid solution due to the modification process, the nonmagnetization ratio of the member can be controlled.

7 Claims, 2 Drawing Sheets

(51) Int. Cl.

| | |
|---|---|
| ***C23C 8/38*** | (2006.01) |
| ***C21D 8/12*** | (2006.01) |
| ***C21D 10/00*** | (2006.01) |
| ***C22C 38/18*** | (2006.01) |
| ***H01F 41/02*** | (2006.01) |
| ***B22F 9/14*** | (2006.01) |
| ***C22C 38/00*** | (2006.01) |
| ***H01F 3/00*** | (2006.01) |

(52) U.S. Cl.
CPC ..... *C22C 38/001* (2013.01); *C22C 38/18* (2013.01); *C23C 8/26* (2013.01); *C23C 8/38* (2013.01); *H01F 41/02* (2013.01); *C21D 8/12* (2013.01); *H01F 3/00* (2013.01)

(58) Field of Classification Search
CPC ..... C21D 10/00; C21D 8/12; C22C 38/18; C22C 38/001; B22F 9/14
See application file for complete search history.

(56) References Cited

FOREIGN PATENT DOCUMENTS

| | | | |
|---|---|---|---|
| JP | 2004-281737 | A | 10/2004 |
| JP | 2006-258139 | A | 9/2006 |
| JP | 2009-030800 | A | 2/2009 |
| JP | 2013-028825 | A | 2/2013 |

* cited by examiner

COMPOSITE MAGNETIC MEMBER AND METHOD OF MANUFACTURING SAME

TECHNICAL FIELD

The present invention relates to a composite magnetic member configured such that a nonmagnetic portion comprising an austenite phase as a solid solution of nitrogen (which may be referred to as a "nitrogen solid solution austenite phase") is formed in a base portion that is formed mainly of a ferrite phase. The present invention relates also to a method of manufacturing the same.

BACKGROUND ART

Electromagnetic devices are used for various purposes, such as a wide variety of motors and electromagnetic valves. Such an electromagnetic device may be provided partially with a nonmagnetic portion (nonmagnetic body) for the purpose of forming a desired magnetic circuit, shielding a leakage magnetic flux, and the like. In general, the nonmagnetic portion can be formed by interposing a different member that is not ferromagnetic between magnetic members or portions, and/or providing an air gap therebetween. Descriptions relevant to this are found in Patent Literature 1, for example.

According to the above approach, however, it cannot be achieved at the same time to reduce the size of an electromagnetic device, enhance the performance, and reduce cost, etc. Therefore, Patent Literature 2, for example, proposes modifying a part of a magnetic member (magnetic body) that constitutes an electromagnetic device so that the part becomes nonmagnetic. Specifically, Patent Literature 2 proposes irradiating laser to a part of a stator core that comprises martensite-based stainless steel, thereby to heat and cool the part so that the part is austenitized (becomes nonmagnetic).

CITATION LIST

Patent Literature

[PTL 1]
JP2006-258139A
[PTL 2]
JP2009-30800A

SUMMARY OF INVENTION

Technical Problem

However, austenitization by local heating as in the patent literature may not necessarily be preferred because it is limited to the case where the mother material (base material) that constitutes the magnetic member is martensite-based stainless steel and thermal strain and the like may possibly occur. In addition, it is difficult to make only a part of the mother material become nonmagnetic, and a boundary between the nonmagnetic portion and the magnetic portion cannot be accurately controlled due to thermal diffusion of nitrogen or other reasons.

The present invention has been created in view of such circumstances, and an object of the present invention is to provide a composite magnetic member configured such that a nonmagnetic portion different from conventional ones is formed in a part of a magnetic member (magnetic body).

Another object of the present invention is to provide a preferred method of manufacturing the same.

Solution to Problem

As a result of intensive studies to achieve the above objects and repeating trial and error, the present inventors have conceived of an idea of generating a nonmagnetic portion comprising an austenite phase as a supersaturated solid solution of nitrogen by irradiating, in a nitrogen-containing atmosphere, near-ultraviolet nanosecond pulse laser to a part (target portion) of a steel material (including stainless steel) that is a magnetic material, and have successfully realized this idea. Developing and generalizing this achievement, the present invention has been accomplished as will be described hereinafter.

<<Composite Magnetic Member>>

(1) The composite magnetic member according to the present invention is characterized by comprising: a base portion comprising a mother material that contains a ferrite phase; and a nonmagnetic portion having an austenite phase that is formed by solid solution of nitrogen (N) into a part of the mother material, the nonmagnetic portion having saturated magnetization smaller than that of the base portion.

(2) The composite magnetic member according to the present invention is configured such that a part (target portion) of a single member comprising a mother material is modified to be a solid solution with a large amount of N thereby being austenitized as a nonmagnetic portion. The nonmagnetic portion according to the present invention is not that which is modified by local heating, and therefore less likely to cause disadvantages, such as thermal strain and deterioration of the mechanical characteristics (such as hardness and strength), in the nonmagnetic portion and in the base portion around the nonmagnetic portion. Moreover, by controlling the width of the nonmagnetic portion to be several micrometers or less, the nonmagnetic portion comprising the modified portion and the magnetic portion comprising the mother material portion can be freely composited and arranged. Furthermore, the amount of N to form the solid solution can be increased thereby to readily allow the austenitization even in low-Cr steel. Thus, various types of steel can be austenitized by solid solution of N. Therefore, the composite magnetic member according to the present invention is available as a constitutional member for a variety of electromagnetic devices.

In the composite magnetic member according to the present invention, the amount of N to form the solid solution contained in the nonmagnetic portion, or the ratio of the austenite phase generated accordingly (austenitization ratio), can be adjusted to thereby control the magnetic characteristics (magnetic permeability, saturated magnetization, magnetic susceptibility, etc.), i.e., a nonmagnetization ratio, of the nonmagnetic portion. When the composite magnetic member according to the present invention is used, therefore, a local site of the magnetic member (magnetic body) can be controlled not only to simply be magnetic or nonmagnetic but also to have desired magnetic characteristics, such as magnetic permeability, which can increase the degree of freedom in formation of a magnetic circuit.

(3) The nonmagnetic portion according to the present invention can vary in its metallic structure configuration depending on the amount of N to form the solid solution (referred also to as an "N amount" or an "N concentration" in a simple term). If the N amount is unduly small, the ratio of a ferrite phase (which may also be referred to as an "alpha phase") is large, and there cannot be obtained an austenite phase (which may also be referred to as a "gamma phase") that exhibits substantially nonmagnetic property. If, on the other hand, the N amount is sufficiently large (e.g., N is in a state of supersaturated solid solution), austenitization (which may be referred to as "fcc transformation" or "gamma transformation") progresses such that the alpha phase of a bcc structure transforms to the gamma phase of an fcc structure. Depending on the degree of transformation, the target portion has a metallic structure in which the alpha phase and the gamma phase are mixed, and the nonmagnetic property becomes significant. When the N amount is not less than a certain value, almost all the nonmagnetic portion becomes the gamma phase, i.e., the nonmagnetic portion becomes substantially completely nonmagnetic. Thus, the nonmagnetic portion exhibits magnetic characteristics (magnetic permeability, saturated magnetization, etc.) depending on the austenitization ratio (which may be referred to as an "fcc transformation ratio") that is a ratio of the gamma phase in the metallic structure. Details of the austenitization ratio will be described later.

The N amount in the nonmagnetic portion can be appropriately adjusted in accordance with the spec of the magnetic member (necessary magnetic characteristics for the nonmagnetic portion), the composition of the mother material, and other factors, but may have to be a value such that the saturated magnetization and/or the magnetic permeability of the nonmagnetic portion are lower than at least those of the base portion. In this regard, it is preferred that 0.2 mass % or more of N is contained in the solid solution.

When the whole of the nonmagnetic portion is 100 mass %, it is preferred that the N amount is 0.2 mass % or more in an embodiment, 0.5 mass % or more in another embodiment, 0.8 mass % or more in still another embodiment, and 0.9 mass % or more in a further embodiment. The N amount as referred to herein is a value in an ordinary temperature region, and may be specified on the basis of results obtained by analyzing the nonmagnetic portion using an electron probe microanalyzer (EPMA). Whether N contained in the nonmagnetic portion is in a solid solution state can be determined by observing a profile obtained using X-ray diffractometry (XRD). If the fcc (gamma phase) peak is shifted to the lower angle side and peaks are substantially not found in association with nitride ($Cr_2N$, CrN, $Fe_3N$, $Fe_4N$, etc.), N contained in the nonmagnetic portion is determined to be in a solid solution state.

In a similar manner, it is preferred that the austenitization ratio (fcc transformation ratio), which is a ratio of the austenite phase to the whole metallic structure of the nonmagnetic portion, is 30 vol % (which may simply be represented by "%") or more in an embodiment, 50% or more in another embodiment, 80% or more in still another embodiment, 90% or more in yet another embodiment, and 95% or more in a further embodiment. The fcc transformation ratio as referred to herein is calculated on the basis of a ratio of the gamma phase (fcc phase) obtained by the Rietvelt refinement or analysis using X-ray diffraction profiles of the nonmagnetic portion. Details thereof will be described later.

As described above, the magnetic level of the nonmagnetic portion can be appropriately controlled in accordance with the spec of the magnetic member, but it is preferred that the nonmagnetization ratio (phi), which is indicative of the magnetic level, is 20% or more in an embodiment, 50% or more in another embodiment, 80% or more in still another embodiment, 95% or more in yet another embodiment, and 98% or more in a further embodiment, for example. Here, the nonmagnetization ratio (phi) is calculated as (phi)=100×(B0−B1)/B0 where B0 represents a saturated magnetization of the base portion and B1 represents a saturated magnetization of the nonmagnetic portion. The nonmagnetization ratio as referred to herein is also a value in an ordinary temperature region, and the saturated magnetization of each portion may be obtained at an ordinary temperature using a magnetic characteristics evaluation apparatus, such as a vibrating sample magnetometer (VSM).

<<Method of Manufacturing Composite Magnetic Member>>

(1) The present invention can be perceived not only as the above-described composite magnetic member but also as a method of manufacturing the same. That is, the present invention may be a method of manufacturing a composite magnetic member. The method is characterized by comprising an irradiation step of irradiating a high energy beam to a target portion in an atmosphere containing nitrogen while relatively moving the high energy beam so that particles are released from the target portion due to ablation, thereby to mix the released particles and the nitrogen in the atmosphere. The target portion is a part of a mother material that contains a ferrite phase. The above-described nonmagnetic portion can be formed in the target portion.

(2) Although the reason is not necessarily sure that the above-described nonmagnetic portion (in particular, the nitrogen solid solution austenite phase) is obtained by the manufacturing method of the present invention, it may be considered under present circumstances as below. When the high energy beam is appropriately irradiated to the target portion comprising the mother material, ablation can occur at the target portion. This ablation causes atoms and the like that constitute the target portion to be released from the target portion such as due to vaporization, evaporation, dispersion, and spreading. Particles thus released (which may be referred to as "released particles") can take a variety of forms, such as atoms, molecules, ions, electrons, photons, radicals, and clusters. Consequently, a reaction field, in which the released particles and atmosphere gas (nitrogen) in the vicinity of the target portion are in a mixture state, can be generated at the target portion where ablation occurs (which may be referred to as an "ablation site") or in the vicinity thereof.

The irradiated area by the high energy beam moves on the target portion thereby to cause the above phenomenon to occur sequentially and substantially continuously, so that the target portion and the vicinity thereof are in a state where a large amount of the released particles and the atmosphere nitrogen that constitute the reaction field is present.

The reaction field comprising the released particles and the atmosphere nitrogen allows the nitrogen to fill the target portion or the vicinity thereof and to perform other actions in a state of forming a solid solution. It thus appears that such a phenomenon is repeated to introduce a sufficient amount of nitrogen deeply inside the target portion thereby to form fine austenite phases in each of which nitrogen forms a solid solution.

Unlike the conventional method of making a magnetic member partially become nonmagnetic and other similar methods, the manufacturing method of the present invention utilizes ablation for formation of the nonmagnetic portion and is unlikely to thermally affect the nonmagnetic portion and the base portion which is located around the nonmagnetic portion and comprises the mother material. According to the manufacturing method of the present invention, therefore, only a necessary local portion can be made nonmagnetic with nearly-unchanged composition and structure of the base portion which constitutes a large part of the magnetic member, while taking advantage of the characteristics (e.g., magnetic property, strength, etc.) possessed originally by the base portion due to its composition and structure.

Moreover, since the manufacturing method of the present invention utilizes ablation as described above, fine nitrogen solid solution austenite phases can be formed for the mother material having a large width within a short period of time and substantially in one step. In addition, the nonmagnetic portion can be freely formed in a desired form regardless of whether the desired form has a wide or narrow width because the form of the nonmagnetic portion is determined in accordance with the trace of the irradiated area by the high energy beam and the irradiated area is variable without limitation. Thus, according to the manufacturing method of the present invention, the magnetic member (base portion) can be formed with the nonmagnetic portion which may be in a variety of forms, such as flat surface like, curved surface-like, curved line-like (including straight line-like), and point-like (including multiple point-like such as multiple spot-like) forms. Furthermore, according to the manufacturing method of the present invention, the nonmagnetic portion can be formed at a specific region, such as depressed region, recessed region, and undercut region, as long as the high energy beam can reach the target portion.

The manufacturing method of the present invention utilizes a high energy (converged) beam, and therefore, local modification of a narrow region can easily be performed, unlike the conventional method of making a magnetic member partially become nonmagnetic and other similar methods. In addition, the width and depth of that region can be controlled in millimeter scale in an embodiment and in micrometer scale in another embodiment. On the assumption that the nonmagnetic portion acts effectively in a magnetic circuit (can be a substantial magnetic resistance), the nonmagnetic portion can be that of which the minimum width is within a narrow width range of 1 mm or less in an embodiment, 100 micrometers or less in another embodiment, 10 micrometer or less in still another embodiment, and 1 micrometer or less in a further embodiment, for example. The nonmagnetic portion may also be that of which the depth from the outermost surface is 10 micrometers or more in an embodiment, 100 micrometers or more in another embodiment, 500 micrometers or more in still another embodiment, and 1 mm or more in a further embodiment, or may otherwise be in a layer-like form that exists within a limited depth range. Such a two-dimensional or three-dimensional form of the nonmagnetic portion can easily be adjusted, such as by adjusting the output density, beam diameter and focal point of the high energy beam and the nitrogen-containing atmosphere. Note that the width of the nonmagnetic portion is a length in a direction orthogonal to the longitudinal direction. Note also that the depth of the nonmagnetic portion is a length from the outermost surface to the deepest part at which the N amount is larger than that of the base portion, which may be determined on the basis of an EPMA image when the cross-section of the nonmagnetic portion is observed.

(3) The "target portion" (nonmagnetic portion) according to the present invention may be located at the outer surface side or otherwise at the inner surface side as long as it is a portion that can be exposed to the high energy beam. The "high energy beam" is a beam that is a light ray or an electron ray and has both a sufficient energy for ablation of the mother material and a strong electric field for generating plasma at the irradiated part and in the vicinity thereof. Specific examples of the high energy beam include laser and electron beam.

The "nitrogen-containing atmosphere" is an atmosphere in which nitrogen exists at a molecular level or an atomic level. Specific examples thereof include: a nitrogen gas atmosphere that consists only of nitrogen gas; a mixture gas atmosphere (including the air atmosphere) that comprises nitrogen gas, inert gas and other gases; and a compound gas atmosphere that contains one or more compounds of nitrogen. The modification process according to the present invention is possible in the air atmosphere or other appropriate atmosphere which contains nitrogen, and the nonmagnetic portion can thereby be formed more easily. It is preferred, however, that the above-described irradiation step is carried out in a nitrogen gas atmosphere or in an atmosphere obtained by diluting nitrogen gas with inert gas when only N should form a solid solution with the mother material. The pressure (gas pressure) of the nitrogen-containing atmosphere may not necessarily be a high pressure, and an ordinary pressure (the atmospheric pressure) may even be sufficient. The temperature of the nitrogen-containing atmosphere may also be sufficient if it is a room temperature (ordinary temperature).

<<Others>>

(1) In the present description, the modification process of increasing the ratio of austenite phases by solid solution of N into the mother material may be referred simply to as "nitriding."

(2) Unless otherwise stated, a numerical range "x to y" as referred to herein includes the lower limit value x and the upper limit value y. Various numerical values or any numerical value included in numerical ranges described herein may be appropriately selected or extracted as a new lower limit value or upper limit value, and any numerical range such as "a to b" may thereby be newly provided using such a new lower limit value or upper limit value.

DESCRIPTION OF EMBODIMENTS

Figure 1:
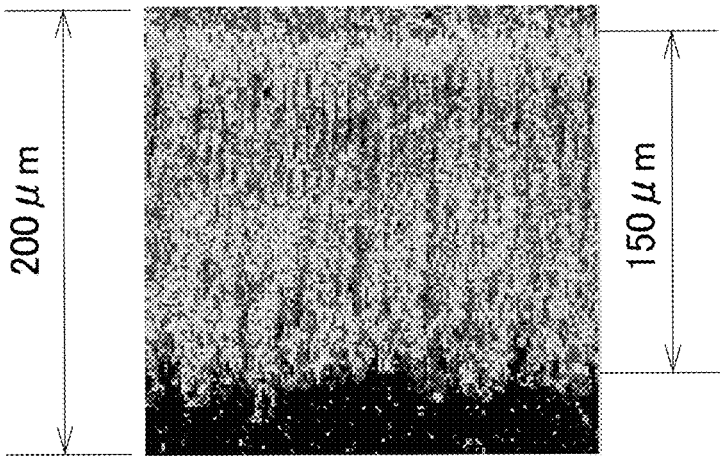
FIG. 1 is an EPMA nitrogen mapping image of Sample 1.

The contents described herein may be applied not only to the composite magnetic member of the present invention but also to a method of manufacturing the same. One or more features freely selected from the description herein may be added to the above-described features of the present invention. Here, features regarding the manufacturing method, when understood as product-by-process, may also be features regarding a product. Which embodiment is the best or not is different in accordance with objectives, required performance and other factors.

<<Mother Material>>

The mother material according to the present invention comprises pure iron or iron alloy that forms a gamma phase in which the introduced nitrogen forms a solid solution. The iron alloy may take a variety of possible compositions, but may preferably be an iron alloy that contains at least chrome (Cr). When Cr is contained in the mother material, N can readily form a solid solution so that the alpha phase transforms stably to the gamma phase. Unduly small amount of Cr in the mother material may make the effect poor. Therefore, when the whole of the mother material is 100 mass %, it is preferred that the content of Cr is 0.1 mass % (which may simply be represented by "%") or more in an embodiment, 0.3% or more in another embodiment, 0.5% or more in still another embodiment, and 0.8% or more in a further embodiment. It is also preferred that the content of Cr is 8% or more in an embodiment, 10% or more in another embodiment, and 12% or more in a further embodiment, because in such a case a composite magnetic member having excellent corrosion resistance can be obtained. The upper limit of the content of Cr may ordinarily be, but is not limited to, 30% or less in an embodiment, and 20% or less in another embodiment. Examples of such a Cr-containing iron alloy include carbon steel (such as JIS SCM steel and SCr steel) and stainless steel. The stainless steel to be the mother material according to the present invention may be enough if it is other than an austenite-based stainless steel which is entirely nonmagnetic. Ferrite-based stainless steel is particularly preferred.

<<Manufacturing Method>>

(1) High Energy Beam

The type of the high energy beam is not limited as long as the high energy beam causes ablation at the target portion of the mother material to form a reaction field in which the released particles generated by the ablation and nitrogen in the atmosphere are mixed together. Examples of the high energy beam include pulse laser and electron beam.

To generate ablation, the target portion of the mother material may have to be imparted with a high energy at a moment. In other words, the target portion of the mother material need be exposed to a high energy beam that has a higher energy density (fluence) than an ablation threshold. Pulse laser having a short pulse width may be preferred as such a high energy beam.

When the operating conditions, such as output power and oscillating frequency, of a laser oscillator are fixed, laser light having a higher fluence can be irradiated to the target portion as the pulse width decreases. In addition, as the pulse width decreases, thermal diffusion to outside of the irradiated area is suppressed and it is possible to promote the ablation and suppress the thermal influence to the mother material. Specifically, it is preferred that the pulse width of the pulse laser is 10 ps to 100 ns in an embodiment, and 1 to 50 ns in another embodiment, for example. If the pulse width is unduly large, it will be difficult to obtain a fluence necessary for ablation, while if the pulse width is unduly small (e.g., 150 fs at which multiphoton absorption occurs), the reaction field necessary for the modification process according to the present invention may not be generated because the energy imparting form by laser will vary.

It is preferred that the output density (fluence) of the pulse laser is 0.3 $MW/cm^2$ to 30 $GW/cm^2$ in an embodiment, and 3 $MW/cm^2$ to 3 $GW/cm^2$ in another embodiment, for example. The output density affects the depth of the nonmagnetic portion. A small output density causes the nonmagnetic portion to be shallow, while a large output density has a significant thermal influence to the mother material. Note that the output density can be obtained by dividing the laser output by the laser spot area.

As the wavelength of the pulse laser decreases, the absorptivity of laser light by the mother material increases to promote the ablation and suppress the deterioration or the like of the non-ablation portion. The wavelength of the pulse laser may be appropriately adjusted thereby to allow the nonmagnetic portion to readily be formed with a sufficient depth. It is preferred that such a wavelength of the pulse laser is shorter than an infrared range in an embodiment, and within an ultraviolet range (including near-ultraviolet range), which is shorter than a visible range, in another embodiment. Specifically, it is preferred that the wavelength of the pulse laser is 700 nm or less in an embodiment, 550 nm or less in another embodiment, and 380 nm or less in a further embodiment. It is also preferred that the wavelength of the pulse laser is 190 nm or more in an embodiment, and 320 nm or more in another embodiment. If the wavelength of the pulse laser is unduly short, absorption of laser by the atmosphere gas will occur, which may be undesirable.

Specific examples of such pulse laser include: excimer laser which utilizes excimer (excited dimer), such as $F_2$ (wavelength of 157 nm), ArF (wavelength of 193 nm), KrF (wavelength of 248 nm), XeCl (wavelength of 308 nm) and XeF (wavelength of 351 nm); and YAG laser which can oscillate at a short wavelength.

(2) Irradiation Step

The irradiation step is a step of irradiating the high energy beam to the surface portion of the mother material in accordance with a desired form of the nonmagnetic portion while moving the irradiated area.

When pulse laser is used as the high energy beam, a continuous nonmagnetic portion can readily be formed through partially superposing (overlapping) the irradiated areas by pulse light beams that oscillate contiguously. The ratio of superposing the irradiated areas by the pulse waves (pulse lap ratio) may be adjusted such as by the oscillating frequency of the pulse laser, the relative movement speed to the target portion (which may be referred to as a "scanning speed"), and the size of the irradiated area at the outermost surface of the target portion (or the focal position of the pulse laser). Depending also on the characteristics of the pulse laser, the pulse lap ratio may preferably be 10% or more and less than 100% in an embodiment, and 20% to 95% in another embodiment, for example. Unduly small pulse lap ratio makes it difficult to form a continuous nonmagnetic portion. Unduly large pulse lap ratio makes it difficult to efficiently perform the modification process and form a uniform nonmagnetic portion.

The pulse lap ratio is calculated as $(r/d)\times100(\%)$, where d represents the beam diameter and r represents an overlapping diameter of contiguous pulse waves. Here, the beam diameter (d) is represented by a width (diameter) that is measured on an orthogonal plane to the laser axis when the beam intensity is at $1/e^2$ level relative to the peak intensity value. The overlapping diameter (r) of contiguous pulse waves is represented by $d-R$, where R is a distance between the centers of contiguous beams.

Conditions such as oscillating frequency, scanning speed and focal position may be adjusted on the basis of the pulse lap ratio. Exemplary conditions are mentioned as below. The oscillating frequency may preferably be 1 to 500 kHz in an embodiment, and 2 to 100 kHz in another embodiment, for example. If the oscillating frequency is unduly low, the scanning speed may have to be reduced and the process cannot be efficiently performed. If the oscillating frequency is unduly high, the laser fluence will be reduced in general, and it may be difficult to form a uniform nonmagnetic portion.

The scanning speed may preferably be 0.1 to 5,000 mm/s in an embodiment, and 1 to 1,000 mm/s in another embodiment, for example. If the scanning speed is unduly low, the process cannot be efficiently performed, while if the scanning speed is unduly high, it may be difficult to form a uniform nonmagnetic portion as with the case in which the correlative oscillating frequency is unduly high.

The irradiated range by each pulse light beam varies depending on the focal position of the pulse laser. The focal position may be located on the outermost surface of the target portion of the mother material, or may also be shifted from the outermost surface. However, as the focal position deviates from the irradiated part by the pulse laser (outermost surface part of the target portion), the output density at the irradiated part decreases to affect the stability of the process in the vicinity of the irradiated part and the depth of the nonmagnetic portion, etc. This tendency is remarkable when the laser is converged to form a fine spot diameter on the irradiated part.

(3) Atmosphere

As previously described, the atmosphere in which the irradiation step is carried out may be a nitrogen-containing atmosphere that allows active nitrogen to be generated due to ablation when the high energy beam is irradiated. Such an atmosphere may be appropriately selected depending on the type of the high energy beam.

The irradiation step may be carried out in a closed atmosphere such as in a chamber, but may also be carried out in an open atmosphere. When laser is used as the high energy beam, the irradiation step is possible even in the air atmosphere of ordinary temperature and ordinary pressure which is an open atmosphere. However, in order to control the amount of nitrogen to form the solid solution while avoiding generation or the like of unnecessary compounds, the irradiation step may preferably be carried out in a nitrogen gas atmosphere or in a mixture gas atmosphere obtained by diluting nitrogen gas with inert gas. Specifically, it is preferred to blow nitrogen gas or the like from above the target portion or from the side of the target portion. The blowing direction of the gas may be adjusted such as for the purpose of suppression of debris caused from the ablation. For example, the blowing direction may be set coaxially with the optical axis of the high energy beam thereby to improve the controllability of the nitrogen-containing atmosphere and uniformity of the nonmagnetic portion.

<<Intended Use>>

The composite magnetic member according to the present invention can be utilized in a variety of electromagnetic devices. For example, the composite magnetic member according to the present invention may preferably be a component that constitutes a magnetic circuit, such as in a motor, actuator (electromagnetic valve, electromagnetic rod, etc.), magnetic sensor, memory, marker, and generator.

When the composite magnetic member according to the present invention operates in a high frequency magnetic field (e.g., 1 kHz to 1 MHz), it is preferred that the nonmagnetic portion is formed in the vicinity of the outermost surface (e.g., with a depth of 0.1 to 1 mm). In consideration of the skin effect, the nonmagnetic portion can exert sufficient effects such as shielding effect even with a shallow (thin) form.

EXAMPLES

First Example

«Preparation of Sample»

(1) Sample Material (Mother Material)

A plurality of sample materials (15.7×6.5×10.0 mm) were prepared by being cut out from commercially available ferrite-based stainless steel (JIS SUS430).

(2) Irradiation Step (Nonmagnetization Process, Nitriding Process)

The high energy beam was prepared as pulse laser having a wavelength within a near-ultraviolet range and a pulse width of nanosecond level (this laser will be referred simply to as "near-ultraviolet nanosecond laser"). This laser was used and irradiated to the target portion of each sample material while nitrogen-containing gas was blown to the target portion. Irradiation conditions were as follows: wavelength of 355 nm; pulse width of <20 ns; output of 0.6 W (output density of 150 MW/cm$^2$); and focal position on the outermost surface of the target portion of the sample material (defocus distance of 0 micrometers, i.e., just focused). The irradiation conditions were finely tuned for each sample material.

Blowing the gas to the target portion was performed from above along the optical axis of the near-ultraviolet nanosecond laser. During this operation, mixture gas obtained by diluting nitrogen gas with argon gas (diluent gas) was used. The concentration of nitrogen to be introduced into the sample material (amount of N to form a solid solution) was adjusted by appropriately varying the nitrogen concentration in the gas.

The laser irradiation was performed such that the pulse lap ratio calculated by the previously-described method was to be 85% and the trace of the irradiated area of each laser light beam was to form parallel multiple straight lines at an interval of 3 to 7 micrometers on the surface of the target portion. This was to allow the target portion to be modified across the whole surface due to the laser irradiation. Each sample was thus obtained as listed in Table 1. A part of the samples was to remain as a sample material for comparison without performing the nitriding process.

«Analysis of Target Portion»

(1) EPMA

The target portion of each of samples except for Sample C2 was analyzed using an electron probe microanalyzer (EPMA). The N concentration (amount of N to form a solid solution) in each target portion obtained through the analysis is also listed in Table 1. FIG. 1 shows a nitrogen mapping image of the target portion of Sample 1 as an example.

(2) XRD

Figure 2:
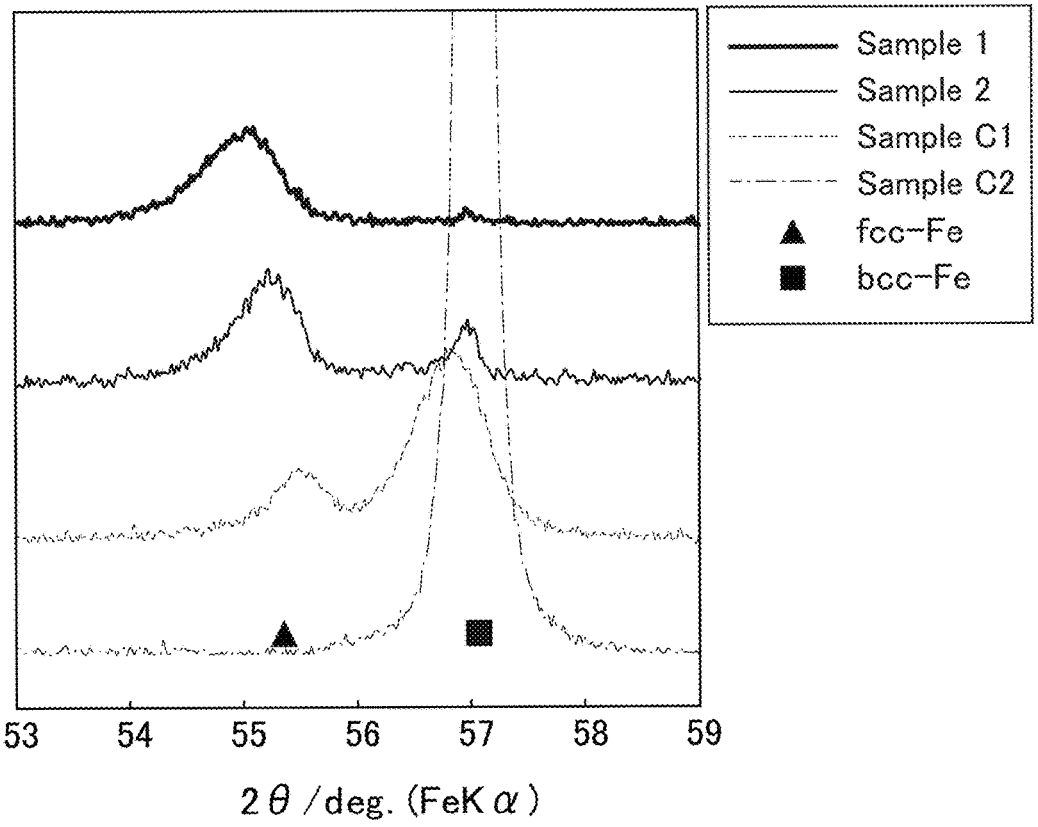
FIG. 2 is a set of XRD profiles of samples.

The target portion of each sample (specifically a part located at a depth of 10 micrometers from the outermost surface) was analyzed using an XRD (FeK-alpha radiation source). FIG. 2 shows the profile of each sample.

Figure 3:
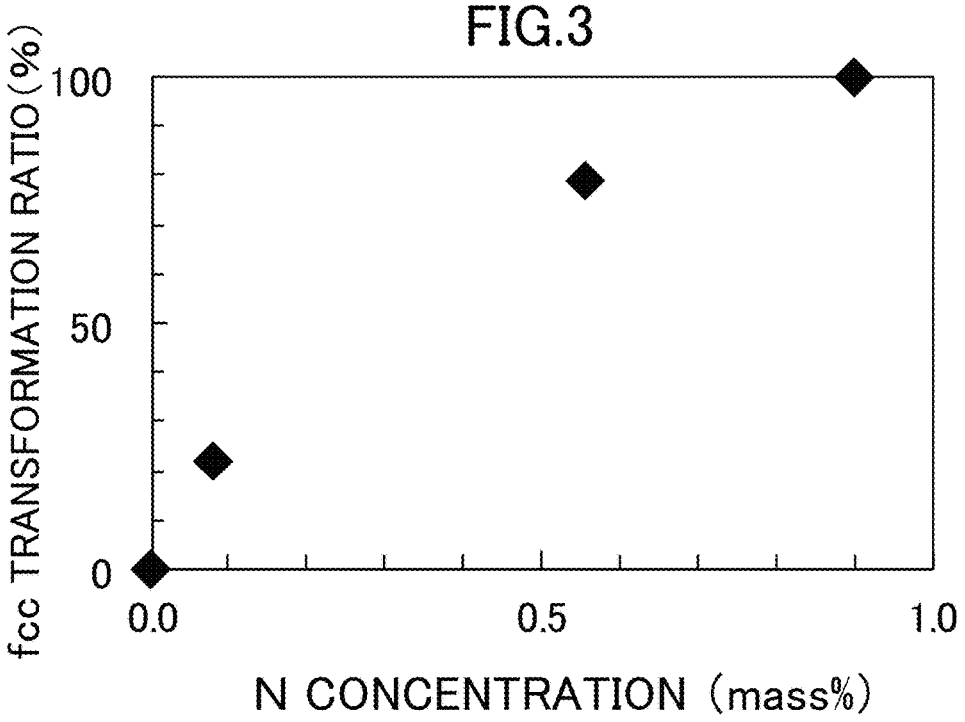
FIG. 3 is a dispersion diagram illustrating a relationship between the nitrogen concentration (amount of N to form solid solution) and the austenitization ratio (fcc transformation ratio).

In addition, the fcc (gamma phase) peak and the bcc (alpha phase) peak appearing in the X-ray diffraction profile of each sample were used to quantify the ratio of the gamma phase (fcc transformation ratio) in the target portion of each sample. This calculation of the fcc transformation ratio was performed using the Rietvelt method. Specifically, the fcc transformation ratio was calculated using Rietvelt analysis software: RIETAN-FP on the assumption of a 2-phase mixture model of alpha and gamma phases. For this calculation, an extended and divided pseudo-Voigt function was used as the fitting function. The fcc transformation ratio thus obtained of each sample is also listed in Table 1. FIG. 3 shows a relationship between the fcc transformation ratio and the N concentration.

(3) Saturated Magnetization

Figure 4:
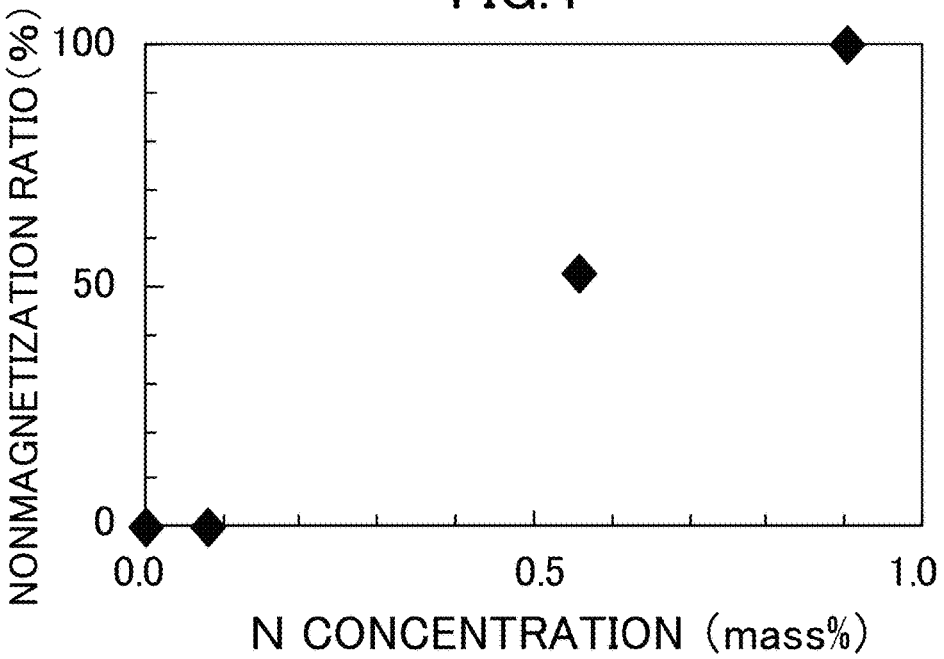
FIG. 4 is a dispersion diagram illustrating a relationship between the nitrogen concentration (amount of N to form solid solution) and the nonmagnetization ratio.

Saturated magnetization (B1) of the target portion of each sample was measured using a VSM. Saturated magnetization (B0) of Sample C2 was also measured in the same manner. The nonmagnetization ratio ((phi)=100×(B0−B1)/B0) calculated for each sample is also listed in Table 1. FIG. 4 shows a relationship between the nonmagnetization ratio of each sample and the N concentration.

«Evaluation»

(1) As understood from FIG. 1, it can be found that the target portion is modified from the outermost surface to a depth of about 150 micrometers. Also as listed in Table 1, 0.1 to 0.9 mass % of N was introduced into the target portion.

Referring also to the X-ray diffraction profiles shown in FIG. 2 in combination with the N concentrations listed in Table 1, it can be found that, as the N concentration increases, the bcc peak decreases whereas the fcc peak increases. In the profile of each sample shown in FIG. 2, peaks of nitride ($Cr_2N$, CrN, $Fe_3N$, $Fe_4N$, etc.) are substantially not found, while the peak shift to the lower angle side is observed as the N concentration increases. It can be said from the above that almost all the N introduced into the target portion is in a state of forming a solid solution and the alpha phase in the mother material is transformed to the gamma phase (austenitized) due to the increased amount of N to form the solid solution.

As apparent from FIG. 3, it can also be found that the fcc transformation ratio increases monotonically with respect to the N concentration (amount of N to form a solid solution) and the fcc transformation ratio is approximately 100% when the N concentration is 0.9 mass %.

(2) As understood from FIG. 4, the nonmagnetization ratio increases as the N concentration increases. When the N concentration was 0.6 mass %, the nonmagnetization ratio was 50%, and when the N concentration was 0.9 mass %, the nonmagnetization ratio was approximately 100%.

Referring also to FIG. 3 in combination with FIG. 4, both of the fcc transformation ratio and the nonmagnetization ratio increase as the N concentration increases, and there can be found correlation between the fcc transformation ratio and the nonmagnetization ratio. It has also been revealed that, however, when the N concentration is 0.1 mass % (<0.2 mass %) which is not higher than the solid solution limit, the target portion is substantially not made nonmagnetic even though the gamma phase is formed. It is therefore apparent that the target portion is ensured to be made nonmagnetic when the N concentration is not less than a certain value and the nonmagnetic level can be controlled by adjusting the N concentration.

Second Example (1) Preparation of Sample

As substitute for the stainless steel used in the first example, three types of sample materials were prepared each comprising an Fe—Cr binary alloy of a different Cr amount. For each sample material, the irradiation step was carried out as with the case of the first example to perform the nitriding process for the target portion, and samples were thus obtained. The composition of each sample material was 0.5%, 1.1% or 14% of Cr and the balance of Fe when the whole of the mother material was 100 mass %.

(2) Analysis/Evaluation of Target Portion

The target portion of each sample was analyzed as with the case of the first example. In all of the samples, the N concentration was (1.3±0.2) mass % and the fcc transformation ratio was >95%. It has also been confirmed from the XRD profiles that the N in the target portion was in a state of forming a solid solution.

When the fcc transformation ratio is close to 100%, the fitting necessary for the Rietvelt analysis may be difficult, and highly accurate calculation of the fcc transformation ratio is not easy. In the present description, therefore, when the bcc peak is at a noise level and only the fcc peak is observed, the fcc transformation ratio is represented as >95% even if the fcc transformation ratio is substantially 100%. In any case, it has been found that the above-described nitriding process allows almost 100% of the target portion to be austenitized in the stainless steel as well as in a mother material of a low concentration of Cr.

[Supplementation]

The target portion treated with the nitriding process through the above-described laser irradiation is not only austenitized or made nonmagnetic by solid solution of nitrogen but also provided with a structure (nitrogen solid solution fine structure) comprising fine crystal grains. Specifically, the average crystal grain diameter can be 10 micrometers or less in an embodiment, 5 micrometers or less in another embodiment, and 1 micrometer or less in a further embodiment, for example. The lower limit of the average crystal grain diameter is not limited, but may be 50 nm or more or 100 nm or more, for example.

The average crystal grain diameter as referred to herein may be specified as follows. First, the cross-sectional structure of the target portion is observed using an electron microscope (TEM). On the assumption that the cross-sectional shape of the observed grain is ellipsoidal, an average value of the long axis (longest) and the short axis (shortest) is determined as one crystal grain diameter. For 5 points randomly sampled within the observed structure cross-section, the crystal grain diameters are in turn calculated to obtain a simple average (arithmetic average), which is determined as the average crystal grain diameter.

Specifically, when the above-described nitriding process was performed for a Cr-free carbon steel (JIS S45C) and a Cr-containing carbon steel (JIS SUS304: 18 mass % of Cr), for example, the N concentration was over 0.9% and the average crystal grain diameter was less than 1 micrometer in both cases. Note that the average crystal grain diameter of an ordinary Fe—Cr alloy not treated with the above-described nitriding process is about several tens of micrometers.

Thus, the target portion (nonmagnetic portion) according to the present invention is not only simply made nonmagnetic due to the solid solution of nitrogen but has a fine structure and can be uniform. According to the present invention, therefore, there can be obtained a composite magnetic member having a nonmagnetic portion that is uniformly made nonmagnetic in a desired form, regardless of whether the target portion (nonmagnetic portion) is wide or narrow and whether Cr is contained or not. As will be understood, such a nonmagnetic portion can be treated with a thermal process thereby to adjust the average crystal grain diameter (coarsen to several to several tens of micrometers).

TABLE 1

| Sample No. | Nitrogen concentration (mass %) | fcc transformation ratio (vol %) | Nonmagnetization ratio (%) |
|---|---|---|---|
| 1 | 0.9 | >95 | >98 |
| 2 | 0.6 | 79 | 53 |
| C1 | 0.1 | 22 | 0 |
| C2 | — (not modified) | 0 | 0 (reference) |

The invention claimed is:

1. A composite magnetic member comprising:

a base portion comprising a mother material that contains a ferrite phase; and a nonmagnetic portion having an austenite phase wherein the nonmagnetic portion is formed by irradiating, in a nitrogen-containing atmosphere, laser light to a part of the mother material so that particles of the mother material are released from the irradiated part of the mother material due to ablation, where the released particles along with nitrogen from the nitrogen-containing atmosphere form a solid solution of nitrogen (N) that fills the part of the mother material that was ablated, the nonmagnetic portion having saturated magnetization smaller than that of the base portion, and the nonmagnetic portion has a width of 1 mm or less, the width being a length in a direction orthogonal to a longitudinal direction.

2. The composite magnetic member as recited in claim 1, wherein the nonmagnetic portion contains 0.2 mass % or more of N when whole of the nonmagnetic portion is 100 mass %.

3. The composite magnetic member as recited in claim 1, wherein the nonmagnetic portion has an austenitization ratio of 30 vol % or more, wherein the austenitization ratio is a ratio of the austenite phase to whole metallic structure of the nonmagnetic portion.

4. The composite magnetic member as recited in claim 1, wherein the nonmagnetic portion has a nonmagnetization ratio (phi) of 20% or more, wherein the nonmagnetization ratio (phi) is defined as:

$$(\text{phi})=100\times(B0-B1)/B0$$

where B0 represents a saturated magnetization of the base portion and B1 represents a saturated magnetization of the nonmagnetic portion.

5. The composite magnetic member as recited in claim 1, wherein the mother material is an iron alloy that contains 0.1 mass % or more of chromium (Cr) when whole of the mother material is 100 mass %.

6. The composite magnetic member as recited in claim 1, wherein the nonmagnetic portion has a depth from an outermost surface of 10 micrometers or more, the depth of the nonmagnetic portion being a length from the outermost surface to the deepest part at which the N amount is larger than that of the base portion.

7. A method of manufacturing a composite magnetic member, the method comprising an irradiation step of irradiating a high energy beam of a laser to a target portion in an atmosphere containing nitrogen while relatively moving the high energy beam so that particles are released from the target portion due to ablation, thereby to mix the released particles and the nitrogen in the atmosphere to form a solid solution of nitrogen (N), the target portion being a part of a mother material that contains a ferrite phase, wherein a nonmagnetic portion as recited is formed in the target portion;

wherein the nonmagnetic portion is formed by the released particles along with nitrogen from the nitrogen-containing atmosphere forming a solid solution that fills the part of the mother material that was ablated, the nonmagnetic portion having saturated magnetization smaller than that of the base portion, and the nonmagnetic portion has a width of 1 mm or less, the width being a length in a direction orthogonal to a longitudinal direction.

* * * * *